United States Patent [19]

Butler

[11] 4,407,255

[45] Oct. 4, 1983

[54] APPARATUS FOR SUPPLYING HIGH VOLTAGE PULSES

[76] Inventor: James G. Butler, 2, Station Ter., Penarth, Glamorgan, Wales

[21] Appl. No.: 168,087

[22] Filed: Jul. 14, 1980

[51] Int. Cl.[3] ..... F02P 3/02

[52] U.S. Cl. ..... 123/595; 123/636

[58] Field of Search ..... 123/636, 637, 649, 650, 123/634, 605, 595

[56] References Cited

U.S. PATENT DOCUMENTS

| | | | |
|---|---|---|---|
| 1,295,528 | 2/1919 | Lang | 123/637 |
| 3,165,099 | 1/1965 | Vanderpoel | 123/637 |
| 3,543,740 | 12/1970 | Vienat | 123/637 |

*Primary Examiner*—Raymond A. Nelli

*Attorney, Agent, or Firm*—Trexler, Bushnell & Wolters, Ltd.

[57] ABSTRACT

An ignition system is provided for creating a continuous stream of high voltage pulses to each spark plug (8) over a predetermined period of time as controlled by the distributor (7). Below the transformer core (1) is positioned a switch (6) incorporating a plate (9) which is magnetically attracted to the transformer when a current flows through the windings. When the contacts of the contact breaker (5) open the supply from the battery (4) to the transformer core (1) is cut off so that the switch (6) closes under the bias of a spring due to the collapse of the magnetic field created in the core. Closure of the switch (6) restores the circuit from the battery (4) to the primary and secondary windings (2) (3) of the transformer and thus during the whole period that the contact breaker (5) is open the switch (6) will intermittently open and close, resulting in the application of a rapid series of high tension pulses to the respective spark plug (8). This gives greatly improved operating characteristics for the engine. The switch (6) can be isolated from the circuit by a push button switch (15) if desired.

10 Claims, 3 Drawing Figures

APPARATUS FOR SUPPLYING HIGH VOLTAGE PULSES

Apparatus which can supply high voltage pulses to create sparks may be used for ignition purposes, such as in the ignition system of an internal combustion engine, although other uses are contemplated.

A conventional internal combustion engine has an ignition system incorporating a transformer whose high tension secondary coil will cause a spark to be formed across the spark gap of a spark plug when the power supply to the primary coil is interrupted, so that the magnetic field created by the primary coil collapses. Thus there is a contact breaker which alternately makes and breaks the circuit to the primary coil once during a complete revolution of a cam for each spark plug in the system. Unless the engine is properly tuned sparking may occur at the wrong moment to ensure correct burning of the fuel in the cylinder of the engine and even with a properly tuned system an appreciable proportion of the fuel is not burned and is passed to the exhaust, thus wasting fuel and causing pollution. Improved firing characteristics can be achieved by providing more than one spark plug for each cylinder but this adds to the cost and makes tuning more difficult.

It is an object of this invention to provide apparatus which can produce high voltage pulses which will create improved ignition sparking, especially, but not exclusively, in an internal combustion engine.

Accordingly this invention provides apparatus for supplying a continuous stream of high voltage pulses at the secondary coil output of a transformer whose primary coil circuit includes a switch, part of which is connected to or is formed by a magnetically attractive body adjacent the transformer core so that the switch part will move to bring the switch to the open condition against a closing bias when a magnetic field passes through the transformer core.

With such an apparatus instead of a single spark occurring across the spark gap of the spark plug of an internal combustion engine, for example, as with present systems, a substantially continuous spark will be produced (in the form of a very rapid sequence of pulses) over a predetermined period of time. This will ensure that better combination characteristics of the fuel in an internal combustion engine will be achieved. It will be appreciated, however, that this apparatus could be used for other purposes where an effectively continuous spark would be useful, for example an ignition device for a gas or oil burner.

Where the apparatus is to be used as part of the ignition system of an internal combustion engine the primary coil circuit will include a voltage source and a contact breaker. If the contact breaker is connected in series with the switch, the contact breaker will be designed to have its contacts closed during the period when a spark is required and the length of time during which sparking will continue will of course depend upon the period of time during which the contact breaker is in the closed state. The contact breaker could be of the conventional form wherein a rotating cam opens and closes a pair of contacts such that movement of the cam follower will cause the contacts to close rather than to open as is usual. Alternatively the contact breaker may comprise a photocell operated by light passing through an opening in a rotating disc, the length of the opening determining the time during which a current will be supplied by an electronic circuit incorporating the photocell to the primary coil of the transformer, and thus determining the time during which sparking will occur under control of the apparatus of this invention. As a further example, a transistorised ignition system may be employed to replace the conventional contact breaker and allow the operating current to be supplied to the primary coil of the transformer for the required length of time for producing the continuous stream of high voltage pulses to each spark plug of the internal combustion engine.

The contact breaker may be connected in parallel with the switch. This enables the contact breaker to operate in a conventional manner with the result that whilst the contact breaker is normally closed the switch will be held open by the magnetic field induced in the transformer but when the contact breaker opens the current from the power supply will flow in series through the switch and the transformer primary coil resulting in intermittent operation of the switch to produce the desired rapid sequence of pulses. This arrangement has the advantage that the timing of the initial spark produced is determined by the opening of the contact breaker. Thus the timing may be adjusted accurately and the automatic adjustment which occurs for example with a vacuum assisted advance mechanism will operate in the correct manner. The parallel circuit incorporating the switch may incorporate an isolating switch so that, when the isolating switch is opened the ignition system will operate in the conventional manner. If desired the parallel circuit may then be utilised only during starting and it may of course be isolated should a malfunction occur. An overload fuse could also be incorporated in the parallel circuit.

The switch, which is to be operated by a magnetic field passing through the transformer core, may take many forms and could comprise a reed switch, mercury switch or trembler switch, for example. Also the switch could be an electronic circuit incorporating a photocell, the switch part, to which the magnetically attractive body is attached, being movable between conditions wherein a light path to the photocell is respectively blocked or unimpeded. The switch would need to be sufficiently robust for the particular situation in which it is used such as in apparatus for supplying high voltage pulses to a sparking plug. Where the switch employs opening and closing contacts ideally a condenser will be connected in parallel with the switch to minimise arcing at the switch contacts.

Preferably, however, the switch will comprise a pair of contacts, one of which is carried on a movable switch arm and is biased into the closed position against the other contact, such as by a light spring and is connected to a magnetically attractive disc positioned adjacent the end of the transformer core. When current is supplied to the primary winding of the transformer a magnetic field will be induced in the transformer core which is effective to attract the body connected to the one contact of the switch, thus opening the switch and interrupting the supply of current to the primary coil. The resulting collapse of the magnetic field will cause a high voltage to be generated in the secondary winding, resulting in a spark across the spark gap of a spark plug and at the same time the body connected to the one contact of the switch will be released to allow the switch to close and complete the circuit through the primary coil. The sequence will be repeated continuously until the switch is rendered inoperative by disconnecting the voltage supply to the primary coil and to the switch for the series arrangement, or by-passing the switch in the parallel arrangement. Thus, a rapid sequence of high voltage pulses will be supplied to the spark plug resulting in a substantially continuous spark being produced.

The invention also extends to a unit for converting an existing transformer to create apparatus of this invention as hereinbefore defined, the unit comprising the switch, connecting leads from the two contacts of the switch for connecting the switch into the primary coil circuit of the transformer and a mounting device for attaching the switch to the body of the transformer so that the magnetically attractive body will lie in the axial magnetic field of the transformer core.

The invention may be performed in various ways and preferred embodiments thereof will now be described with reference to the accompanying drawing, in which.

Figure 2:
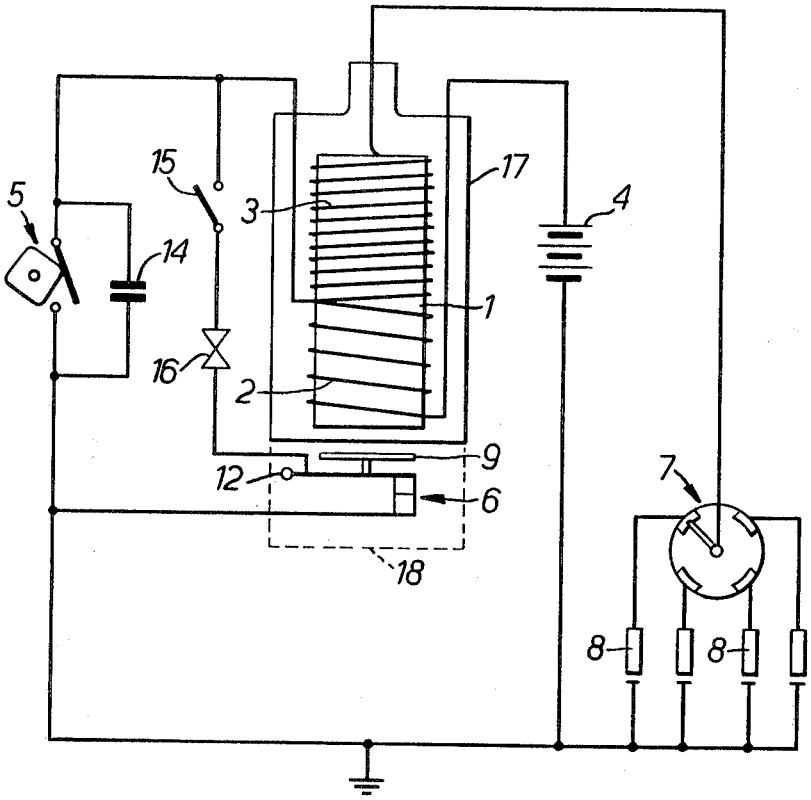
FIG. 2 illustrates an alternative ignition system of the invention.
Figure 3:
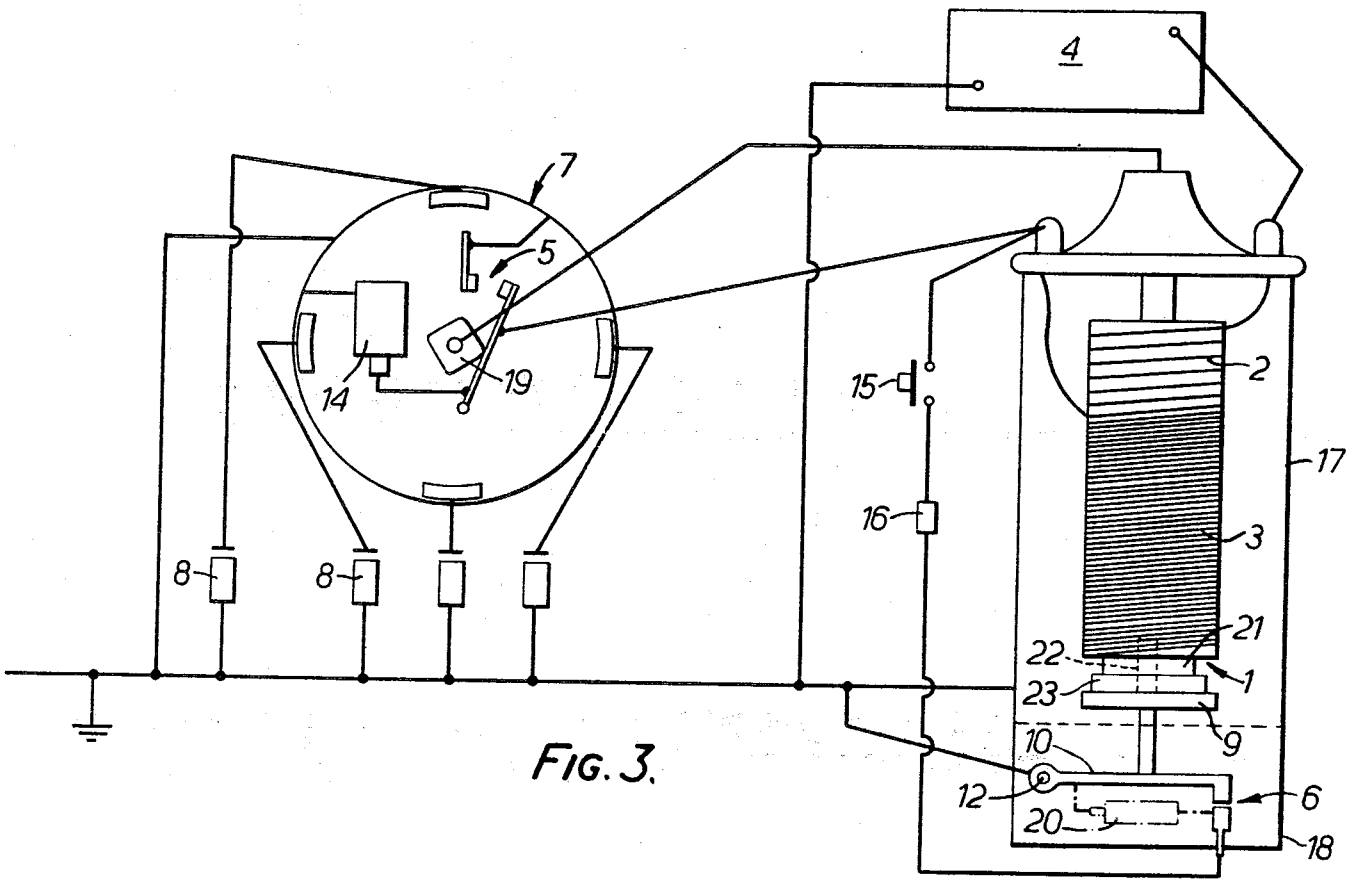

FIG. 3 comprises a schematic drawing showing the circuit of FIG. 2 as incorporated in the ignition system of a vehicle.

Figure 1:
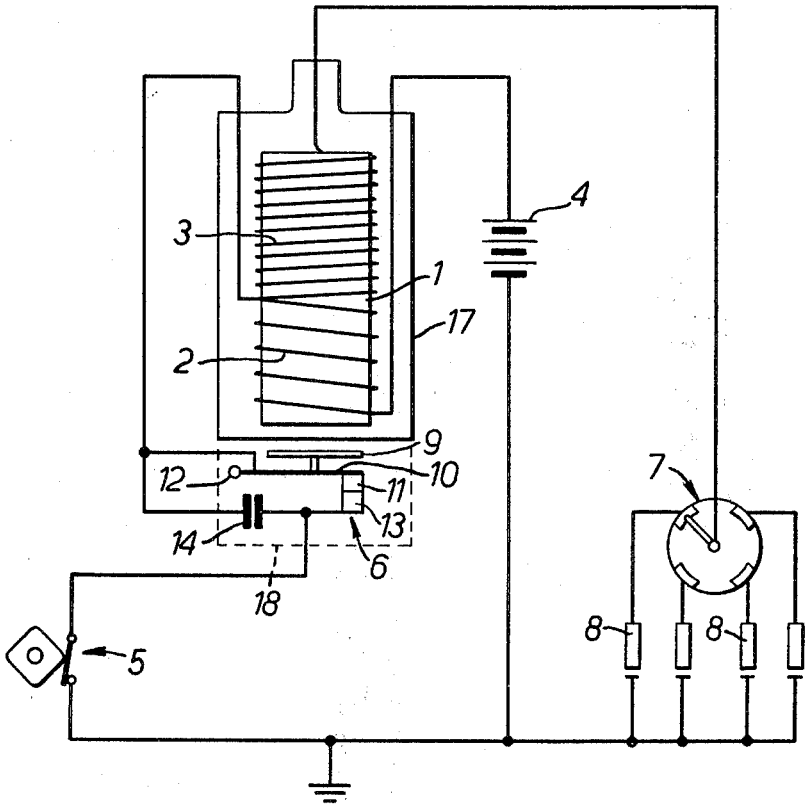
FIG. 1 illustrates an ignition system for an internal combustion engine utilising apparatus according to this invention.

The device of FIG. 1 incorporates a transformer having a core 1, primary winding 2 and secondary winding 3. The primary winding 2 is connected to a power supply 4 through a contact breaker device 5 and a switch 6. The secondary winding 3 is connected through a conventional distributor 7 to spark plugs 8 in the cylinders of an internal combustion engine.

When the switch of contact breaker 5 is in the closed condition a magnetic field is induced in the core 1 which attracts a plate 9 of magnetically attractive material which is attached to an arm 10 carrying one of the contacts 11 of the switch 6 and pivoted at 12. The arm 10 is normally biased by a spring (not shown) so as to close the contacts 11 and 13 of the switch 6. When the contacts open the supply of current to the primary winding 2 is interrupted and the high voltage generated in the secondary winding by collapse of the magnetic field in the core 1 is passed to one of the spark plugs 8 through the distributor 7. Collapse of the magnetic field allows the contacts 11 and 13 to close again and the sequence is repeated at a very rapid rate during the time that the contact breaker 5 is closed, so that a sequence of high voltage pulses is supplied to the one spark plug 8. A condensor 14 is connected in parallel across the switch 6 to suppress arcing across the contacts 11 and 13.

The contact breaker device 5 can comprise a conventional arrangement of a rotating cam which operates on a cam follower attached to a contact arm biased by a spring so that the contacts will normally be open. As each lobe of the cam operates on the cam follower the contacts will close so as to complete the circuit through the supply source 4 and the primary windings 2 to the switch 6 shown in FIG. 1. The length of time during which the supply source is thus connected into the circuit (and therefore the time during which the rapid sequence of sparks are applied to one of the spark plugs 8) will depend upon the length of the cam follower surface of the cam follower.

As an alternative the contact breaker device 5 could be replaced by the device of a photocell and a rotating disc incorporating slots which allow light to pass through to the photocell so as to complete the circuit through the switch and the primary winding 2. The period during which the spark plug is operative can then of course be modified by varying the length of the slot.

In the alternative arrangement illustrated in FIG. 2, the switch 6 is connected in parallel with the contact breaker 5 and the condensor 14 is connected directly across the contact breaker and can therefore be the existing condensor present in a conventional circuit. An isolating switch 15 enables the switch 6 to be brought into use as and when required or to be isolated if a malfunction should occur, thus enabling the system to operate in a conventional manner under control solely of the contact breaker 5. A trip fuse 16 will allow for any overload occurring and this could be associated with a warning light on the dashboard of the vehicle. With this circuit, when the circuit breaker switch is in the closed position the switch 6, which will be held in the open position by the magnetic field induced by the current flowing through the primary coil 2, will be by-passed. However when the circuit breaker switch opens the current through the coil 2 will be interrupted resulting in the collapse of the magnetic field, the occurance of a spark in one of the spark plugs 8, and closure of the switch 6. The switch 6 will then open and close intermittently, thus causing a sequence of sparks in the spark plug 8 until such time as the circuit breaker switch reverts to the closed condition. It will be appreciated that the isolating switch 15 could be linked with the choke of a vehicle so that the switch 6 is only effective during starting whilst the choke is in operation.

It will be appreciated that the switch 6 could be replaced by a photocell which would be operated by means of a member moving in and out of the light path to the photocell as the plate 9 is intermittently attracted to the transformer core 1. This would remove the possibility of sparking occurring in the control circuit.

FIG. 3 illustrates how the circuit of FIG. 2 might appear in the actual layout of the ignition system of a vehicle. For clarity, the rotor arm of the distributor 7 has been omitted to show clearly the contact breaker device 5 operated by a cam 19. This Figure also illustrates how an auxiliary capacitor 20 might be incorporated into the circuit if the existing capacitor 14 in the conventional ignition system is of too small a value for the modified circuit.

A conventional vehicle ignition system may readily be adapted to the form illustrated in FIG. 2 of the drawings in particular by incorporating the parallel circuit of the switch 6, isolating switch 15 and fuse 16 across the contact breaker 5 and attaching the switch 6 assembly adjacent the end of the transformer casing 17. Thus the switch 6 with its associated magnetically attractive plate 9 could be housed within a casing extension 18 (shown in dashed outlined) which is adapted to clip onto the existing casing 17. The fuse 16 and isolating switch 15 could be positioned where required. With the arrangement shown in FIG. 1 the switch 6 and associated parts together with the condenser 14 could be housed in the casing extension 18 clipped onto the casing 17. Again a circuit could readily be incorporated into that of an existing ignition system. Where a complete ignition system is being installed then a custom-made unit comprising the transformer with the switch 6 positioned therebelow within a single casing could be supplied.

The positioning of the magnetically attractive plate 9 may be modified, as illustrated in FIG. 3, so as to be within the main casing 17 and adjacent the ceramic core 21 of the core 1, a pin 22 attached to the plate 9 passing into a hole in the core 21 to act as a bearing member as the plate 9 moves. Biasing of the plate 9 away from the core 1 (to cause closure of the switch 6) is achieved by a resilient pad 23, such as of sorbo rubber. Because the plate 9 is much closer to the core 1 in this arrangement, a strong closing bias, by the pad 23, can be provided to ensure positive closure of the switch 6 and a reduction in possible arcing.

This apparatus can have many uses, some of which are mentioned above. Additionally it could be used to provide a continuous flame (the spark) for the purpose of igniting various materials or fuels or, for example, for the localised destruction of weeds.

I claim:

1. A retrofit ignition conversion apparatus for backfitting a conventional non-vibrator ignition transformer (17) equipped with a magnetically transparent housing-end for supplemental operation as a vibrator type ignition transformer for supplying a continuous stream of high-voltage pulses from said ignition transformer (17) secondary coil (3) comprising:

(a) a contact breaker (5) connected to a primary winding (2), (b) a means (15) for connecting a voltage source (4) to said primary winding (2), (c) said means (15) constituting an isolating switch, (d) a vibrator switch (6) adapted to be physically mounted (18) to said conventional ignition transformer (17) and electrically connected to said primary winding (2), said vibrator switch (6) being normally biased closed under mechanically elastic pressure inherent in many such known vibrator switch structures, (e) a magnetically attractive means (9) associated with said vibrator switch (6) and disposed outside said conventional transformer (17) casing in sufficient proximity to the transformer case end to insure functional magnetic coupling with said magnetically attractive means (9) such that said vibrator switch (6) will be caused to move to an open condition against said elastic closing bias when a magnetic field passes through the transformer core whereby when said switch (6) and said primary winding (2) are connected to a voltage source (4), the opening and closing of said switch (6) will result in a stream of high voltage pulses from said ignition transformer (17) secondary winding (3), (f) said retrofit apparatus further comprising said contact breaker (5) connected in parallel with the series combination of said isolating switch (15) and said vibrator switch (6) such that when said isolating switch (15) is opened, said conventional ignition transformer will operate independently of said retrofit system.

2. Apparatus according to claim 1, wherein the contact breaker is connected in series with the switch, the contact breaker being designed to have its contacts closed during the period when a spark is required.

3. Apparatus according to claim 2, wherein the contact breaker includes a rotating cam, a cam follower, and a pair of contacts, and is constructed so that the rotating cam opens and closes the pair of contacts in such a way that movement of the cam follower will cause the contacts to close.

4. Apparatus according to claim 2, wherein the contact breaker comprises a rotating disc formed with an opening and an electronic circuit incorporating a photocell operated by light passing through the opening in the rotating disc, the length of the opening determining the time during which a current will be supplied by the electronic circuit to the primary coil of the transformer, and thus determining the period during which sparking will occur.

5. Apparatus according to claim 1 incorporating a transistorised ignition system which will operate to allow the operating current to be supplied to the primary coil of the transformer for the required length of time for producing the continuous stream of high voltage pulses to each spark plug of the internal combustion engine.

6. Apparatus according to claim 1, wherein an overload fuse is incorporated in the parallel circuit.

7. Apparatus according to claim 1, wherein the switch which is to be operated by a magnetic field passing through the transformer core is a mechanically operated switch.

8. Apparatus according to claim 7, wherein a condenser is connected in parallel with the switch to minimise arcing at the switch contacts.

9. Apparatus according to claim 1, wherein the switch is an electronic circuit incorporating a photocell, the switch part, to which the magnetically attractive body is attached, being movable between conditions wherein a light path to the photocell is respectively blocked or unimpeded.

10. Apparatus according to claim 1, wherein the switch comprises a pair of contacts, one of which is carried on a movable switch arm and is biased into the closed position against the other contact, and is connected to a magnetically attractive disc positioned adjacent the end of the transformer core.

* * * * *